US007780539B2

(12) United States Patent
Whitefield

(10) Patent No.: US 7,780,539 B2
(45) Date of Patent: Aug. 24, 2010

(54) BALL TRAP

(75) Inventor: Kevin Whitefield, Attleborough (GB)

(73) Assignee: Holesim Limited (GB)

( * ) Notice: Subject to any disclaimer, the term of this patent is extended or adjusted under 35 U.S.C. 154(b) by 0 days.

(21) Appl. No.: 11/571,431

(22) PCT Filed: Jun. 8, 2005

(86) PCT No.: PCT/GB2005/002281

§ 371 (c)(1),
(2), (4) Date: Mar. 17, 2007

(87) PCT Pub. No.: WO2006/003364

PCT Pub. Date: Jan. 12, 2006

(65) Prior Publication Data

US 2007/0259728 A1 Nov. 8, 2007

(30) Foreign Application Priority Data

Jul. 1, 2004 (GB) ..... 0414761.7

(51) Int. Cl.
*A63B 69/36* (2006.01)

(52) U.S. Cl. ..... 473/188; 473/106; 473/446

(58) Field of Classification Search ..... 473/186–189, 473/106, 446

See application file for complete search history.

(56) References Cited

U.S. PATENT DOCUMENTS

| | | | | |
|---|---|---|---|---|
| 1,427,537 | A | | 8/1922 | Long |
| 1,513,917 | A | | 11/1924 | Long |
| 1,529,749 | A | | 3/1925 | Morrison, Jr. |
| 1,600,475 | A | | 9/1926 | Keller |
| 1,663,889 | A | | 3/1928 | Rolfe |
| 1,973,513 | A | | 9/1934 | Stayton et al. |
| 2,742,293 | A | | 4/1956 | Davis |
| 2,788,977 | A | | 4/1957 | Lusk |
| 2,899,207 | A | | 8/1959 | Billinghurst |
| 2,933,318 | A | * | 4/1960 | Boynton ..... 473/186 |
| 3,184,240 | A | | 5/1965 | Gleeson |
| 3,313,544 | A | | 4/1967 | Davis |
| 3,424,464 | A | | 1/1969 | Greenhouse |
| 3,507,499 | A | | 4/1970 | Rice |
| 3,858,888 | A | | 1/1975 | Young |
| 3,909,007 | A | | 9/1975 | Wuertemburg et al. |
| 4,647,047 | A | | 3/1987 | Little |

(Continued)

FOREIGN PATENT DOCUMENTS

| | | |
|---|---|---|
| DE | 328386 | 10/1920 |

(Continued)

*Primary Examiner*—Mark S Graham
(74) *Attorney, Agent, or Firm*—Brooks Kushman P.C.

(57) ABSTRACT

A ball trap comprises a carrier about which is spaced a number of suspended flaps so as to be positioned, in use, about the surface on which the ball travels and which are configured, so that when a—or the—flap is impacted by a ball, the flap is pushed aside to a position where, provided the impact force is sufficient, the ball passes underneath the flap and the flap falls back to its position of rest to prevent the ball from escaping; characterised by the feature that the flap region which the ball pushes aside on impact is spaced sufficiently, radially outward from the carrier that the same region can subsequently come down behind the ball and act as the escape-preventing means.

9 Claims, 8 Drawing Sheets

U.S. PATENT DOCUMENTS

| | | | | |
|---|---|---|---|---|
| 4,691,922 | A * | 9/1987 | Peel et al. | 473/188 |
| 4,896,886 | A | 1/1990 | Colley | |
| D333,857 | S | 3/1993 | Schropp | |
| 5,655,776 | A | 8/1997 | Kaulfuerst | |
| 5,779,567 | A | 7/1998 | Durso | |
| 5,971,863 | A | 10/1999 | Durso | |
| 6,595,864 | B2 * | 7/2003 | Fuller | 473/188 |
| 6,866,591 | B2 * | 3/2005 | Bennett | 473/188 |
| 2003/0181252 | A1 | 9/2003 | Bennett | |

FOREIGN PATENT DOCUMENTS

| | | | |
|---|---|---|---|
| GB | 190901476 | | 8/1909 |
| GB | 191514649 | | 8/1916 |
| GB | 107540 | | 7/1917 |
| GB | 128523 | | 6/1919 |
| GB | 184409 | | 8/1922 |
| GB | 400422 | | 10/1933 |
| GB | 1350842 | | 6/1974 |
| GB | 2015353 | A | 9/1979 |
| GB | 2069343 | A | 8/1981 |
| GB | 2194893 | A | 3/1988 |
| GB | 2257637 | A | 1/1993 |
| GB | 2274066 | A | 7/1994 |
| WO | 9723259 | | 7/1997 |

* cited by examiner

BALL TRAP

FIELD OF THE INVENTION

The invention relates to ball traps. The specific description of the present invention is concerned with a golf ball trap. However, the invention is destined to apply to other ball traps for example football, marbles and ten pin bowling ball traps.

Throughout this specification, the term 'flap' is to be interpreted broadly but is not intended to cover 'pins or arrays of pins' within its meaning.

BACKGROUND TO THE INVENTION AND PRIOR ART KNOWN TO THE APPLICANTS(S)

Golf is a popular pastime throughout the world. Most players strive for two things; to play more and to improve their game. The sport generally requires a large specific area set with a hole, is time consuming and can be expensive to play regularly. These factors combine to limit access to the sport.

For these reasons there is a large amount of practice equipment available to the golfer. These range from small putting targets and chipping nets to large permanent putting surfaces. Most of these devices are primarily aimed at practice rather than play and this is generally true of ball traps and hole simulators. Known devices are generally unidirectional or have ramps that deflect the ball, making them unable to truly simulate a hole, or are permanently fixed, inflexible or cumbersome.

The following prior art has been identified by the applicant (s): GB184409, GB400422, U.S. Pat. No. 5,971,863, U.S. Pat. No. 5,779,567, U.S. Pat. No. 5,655,776, WO9723259, U.S. Pat. No. 4,896,886, U.S. Pat. No. 4,647,047, U.S. Pat. No. 3,909,007, U.S. Pat. No. 3,838,888, U.S. Pat. No. 3,507,499, U.S. Pat. No. 3,424,464, U.S. Pat. No. 1,600,475, U.S. Pat. No. 333,857, U.S. Pat. No. 3,313,544, U.S. Pat. No. 3,184,240, U.S. Pat. No. 2,899,207, U.S. Pat. No. 2,742,293, U.S. Pat. No. 1,663,889, U.S. Pat. No. 1,529,749, U.S. Pat. No. 1,513,917, U.S. Pat. No. 1,427,537, GB2257637, GB2274066, GB2194893, GB2069343, GB2015353, GB1350842, GB128523, GB191514649, GB107540 and GB190901476.

The closest two documents of prior art are GB2069343 and U.S. Pat. No. 3,184,240. GB2069343 is concerned with an array of pins acting as escape-preventing means.

The closest ball trap using a number of flaps is U.S. Pat. No. 3,184,240. This device requires each flap to have two flap portions, one against which, in use, a ball would impact, causing the flap to pivot inwardly so that a second portion of tie flap would cover the ball to prevent tie ball from escaping. The device also has a conical base requiring the ball to ride up a slope before hitting the first portion of a given flap.

SUMMARY OF THE INVENTION

In its broadest independent aspect, the invention provides a ball trap comprising a carrier about which is spaced a number of suspended flaps so as to be positioned, in use, about the surface on which the ball travels and which are configured, so that when a—or the—flap is impacted by a ball, the flap is pushed aside to a position where, provided the impact force is sufficient, the ball passes underneath the flap and the flap falls back to its position of rest to prevent the ball from escaping; characterised by the feature that the flap region which the ball pushes aside on impact is spaced sufficiently radially outward from the carrier that the same region can subsequently come down behind the ball and act as the escape-preventing means.

This configuration renders the trap altogether more compact and simpler than the prior art.

It also more closely simulates a hole if the ball trap is used as a golf ball trap.

In a subsidiary aspect in accordance with the invention's broadest independent aspect, each flap has a lower surface which, in the flap's pushed-aside position, can lie substantially parallel to the surface on which tie ball travels. This allows the flap to closely simulate the edge of a hole which may be particularly beneficial in a golf simulation application.

In a further subsidiary aspect, each flap's ball-contacting surface is, in use, curved in a plane substantially parallel to the ground. Such a profile works in combination with the ball enabling entry to the simulated hole whilst restricting escape from the device once inside much as a real hole would do in a similar situation.

In another subsidiary aspect, each flap's ball-contacting surface is substantially arcuate so is that a group of flaps mimics the effect of the edge of a hole on a ball. The advantages of this structure come to light when using the ball trap to simulate a portion of an edge of a hole.

In a further subsidiary aspect, there are provided three or more flaps. Three or more flaps achieve advantageous escape-preventing actions.

In a further subsidiary aspect, the or each flap is T-shaped. This configuration presents the ball trap with an ideal combination of compactness and reliable trapping capacity.

In a further subsidiary aspect, the carrier is freely rotatable. This provides the device with enhanced longevity and with a closer simulation of a ball's interaction with a hole.

In a further subsidiary aspect, the or each flap is curved or twisted inwardly at the flap side so that when a ball meets the flap side-on it tends to push the flap aside.

In a further subsidiary aspect, the or each flap is curved or twisted upwardly at the flap side so that when a ball meets the flap side-on it tends to push the flap aside.

In a further subsidiary aspect, the or each flap has a projection or integral surface which meets an abutment on its carrier when the flap is in its position of rest, said abutment being configured to prevent the flap from being able to swing outwards.

In a further subsidiary aspect, the or each flap is part of a carrier; the flap and/or carrier is configured to be sufficiently flexible so that when the ball travels at a velocity in excess of a pre-determined value, it causes the flap and/or carrier to flex to allow the ball to escape from the trap. This allows a further improved simulation of a hole.

DESCRIPTION

The present invention accurately simulates a golf hole by trapping a ball rolling along a surface in a similar manner to ball behaviour in a proper game on a golf course. While this description relates to golf, the device can be scaled and applied to work with smaller or larger balls.

The present invention is described in the following text, with reference to the accompanying drawings.

Figure 1:
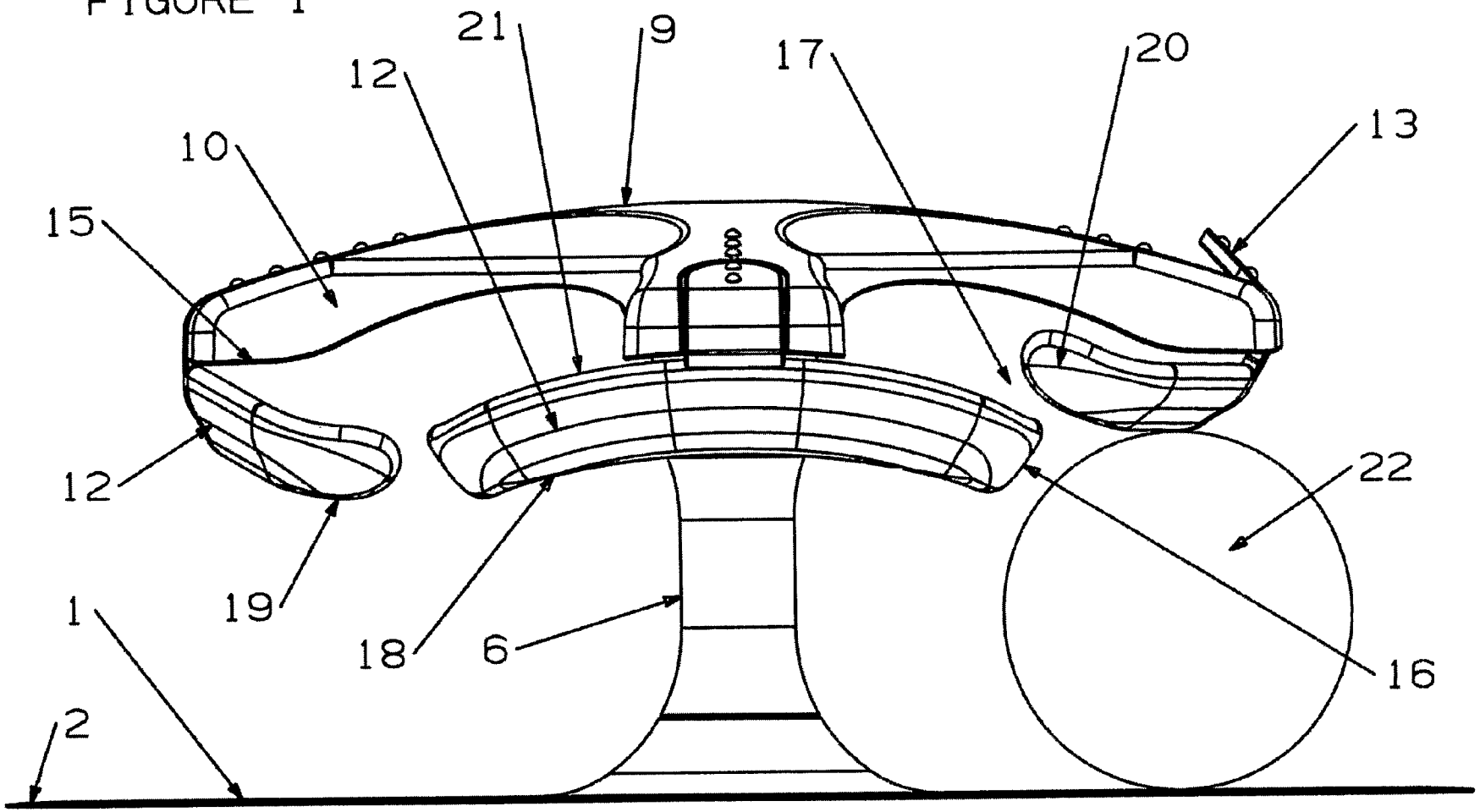
FIG. 1 is a side view showing the general assembly of the invention.
Figures 2, 4:
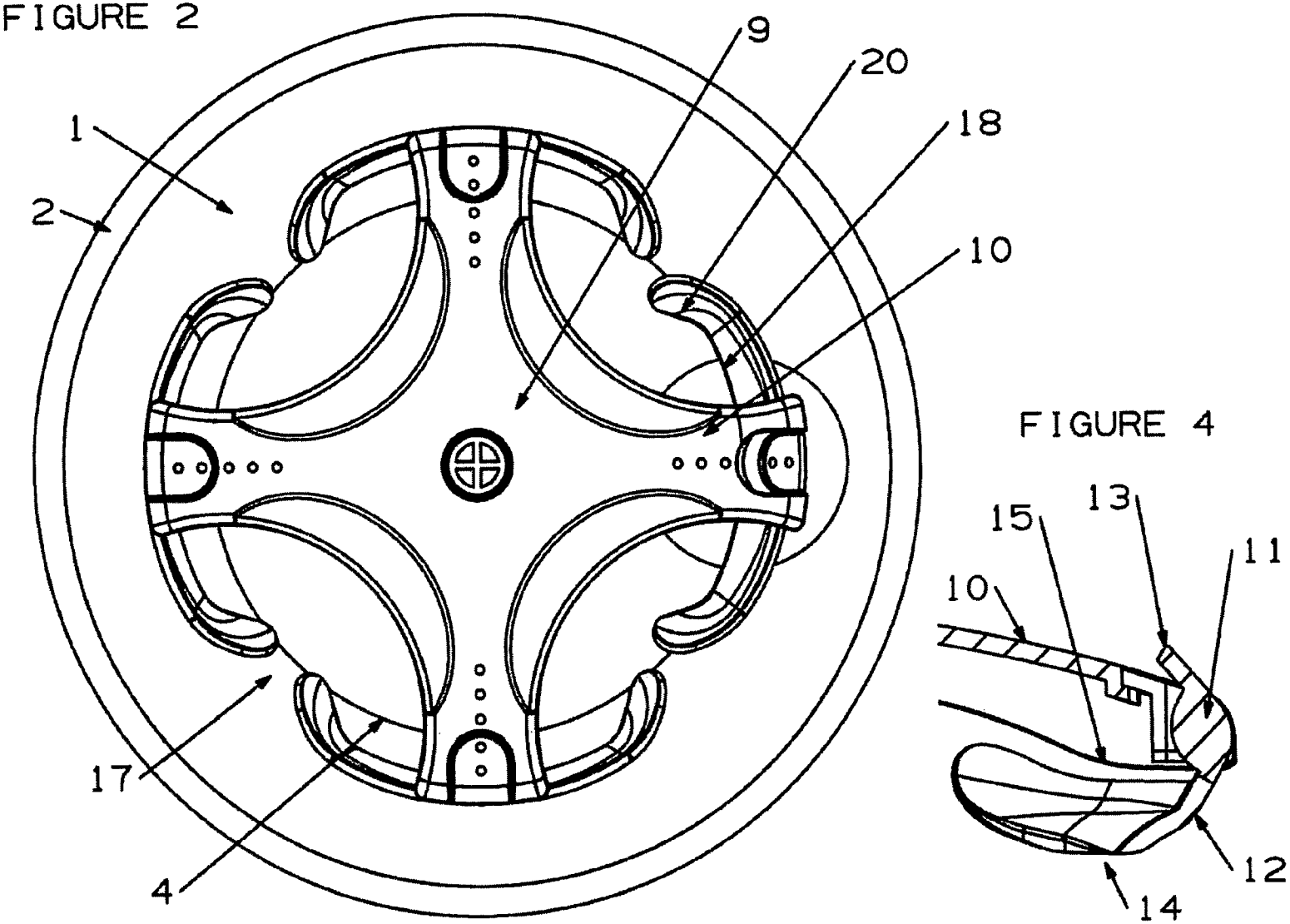
FIG. 2 is a plan view of the ball trap shown in FIG. 1.
FIG. 4 is a part section view of the hinge of the ball trap shown in FIG. 1.
Figure 3:
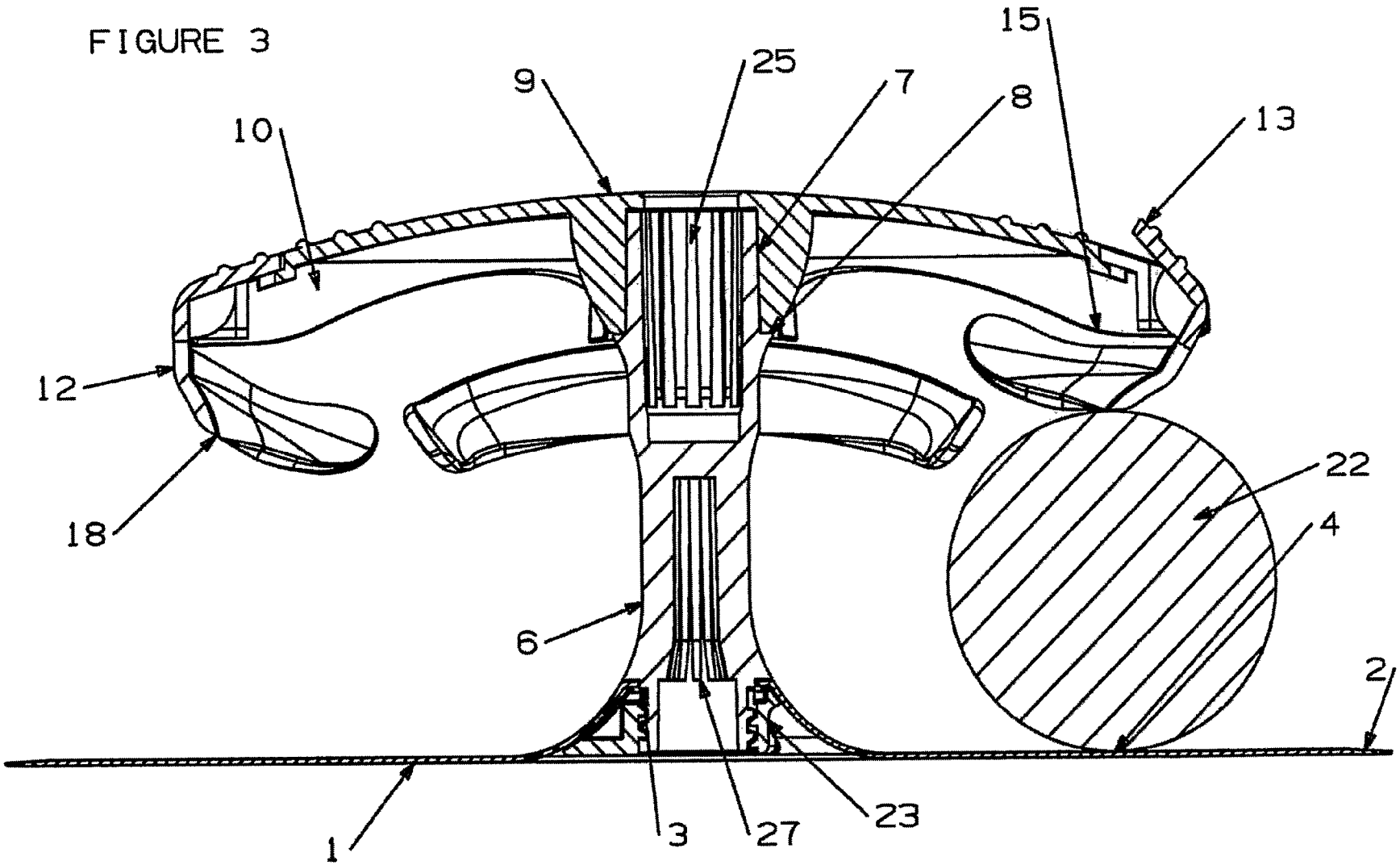
FIG. 3 is a section view of the general assembly shown in FIG. 1.
Figure 5:
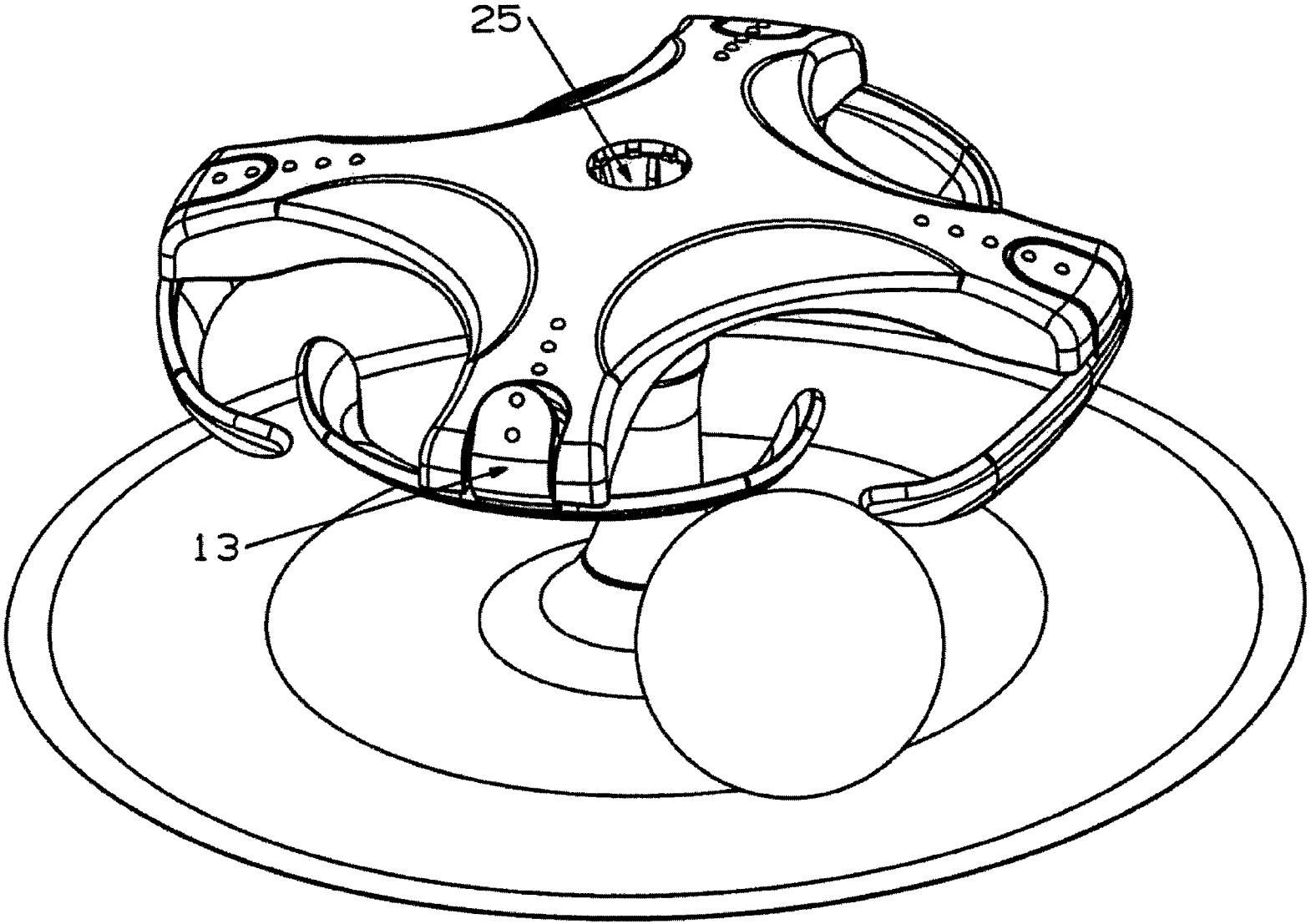
FIG. 5 is a view of a ball acting on the side of the flap.
Figure 6:
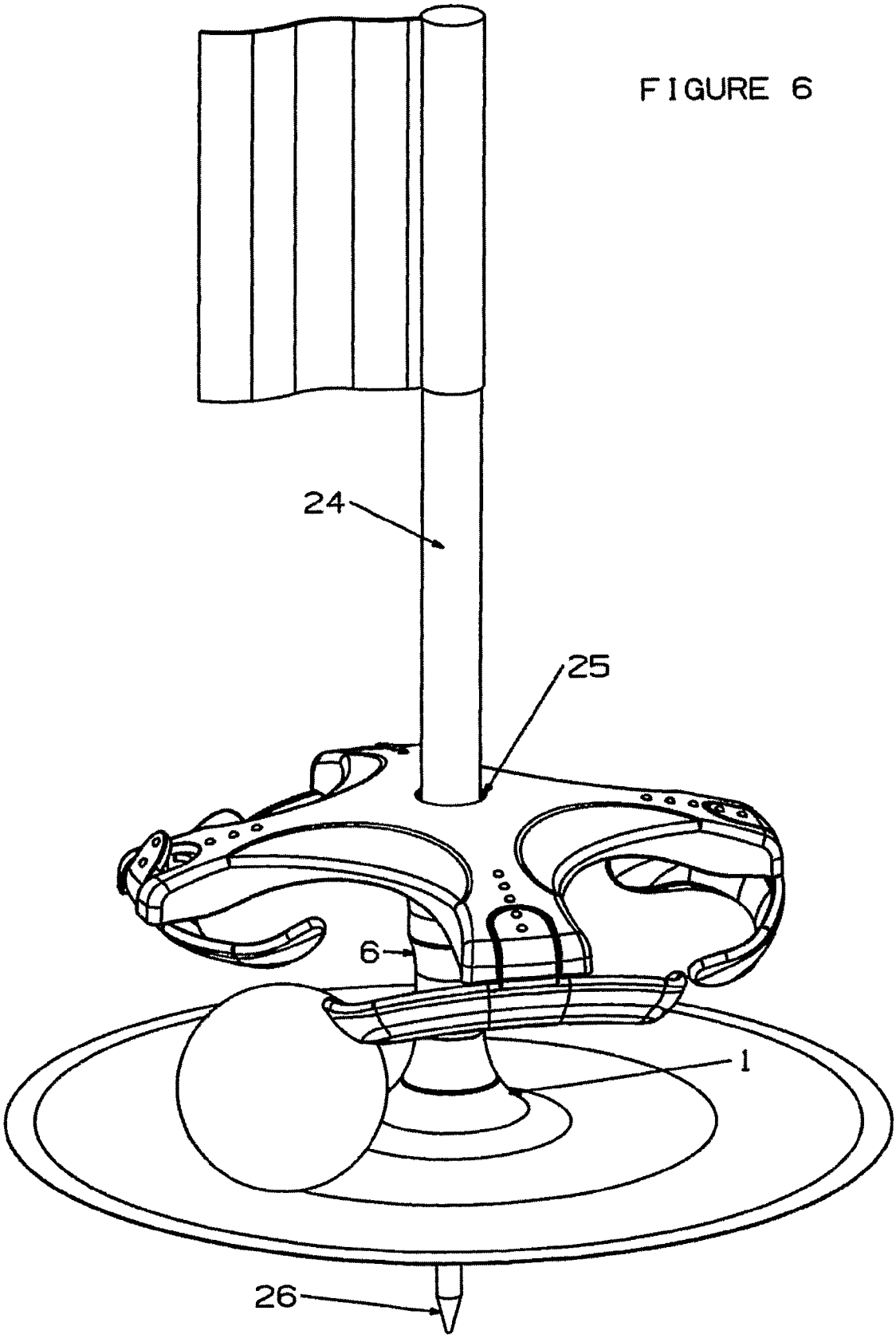
FIG. 6 is a perspective view of the device as it would be set up on a suitable surface.

By way of example, and with initial reference to FIGS. 1 to 6 the device consists of a thin flat base 1 larger than the diameter of the circular hole the device is to simulate. The edge of the base 1 may have a chamfer or radius 2. The simulated hole is marked 4 on the upper side of the base 1 and may additionally be augmented by a slight depression or a series of holes at the same diameter. A vertical post 6 rises from the centre of the simulated hole 4 and is attached to the base 1 throughout a hole 3. Post 6 is held in place by a bayonet feature or separate nut 23 on the underside of base 1. Alternatively post 6 may be an integral part of base 1.

The top of post 6 has a vertical spigot 7 and flange 8 on to which is mounted carrier 9. Spigot 7 may be tapered with a matching taper on carrier 9. Carrier 9 has a plurality of arms 10 radiating outwards. At the ends of each arm 10 is a hinge 11 and flap 12 largely is suspended from the hinge 11. A tab 13 extending inwards from the top of the flap 12 contacts the top of the arm 10 preventing the lower part 14 of the flap 12 from rotating outwards but allowing full rotation inwards until the flap 12 contacts the lower profile 15 of the arm 10.

The lower part 14 of the flap 12 extends sideways from the hinge 11 in both directions in a circular path concentric and further out to the simulated hole outline 4. The sides 16 of the flap 12 stop at a point that allows clearance 17 to the adjacent flap in all articulations of both flaps. The lower edge 18 of the flap 12 may be straight but is preferably curved down at the ends when flap 12 is in its rest position. Furthermore it is preferred the lower edge 18 is approximate to the simulated hole outline when flap 12 is in its operating position. Towards the sides 16 there is a chamfer or radius 19. Optionally at the sides of the flap 12 there is a tab 20 extending inwards. The upper edges 21 of the flap may be any profile but must provide sufficient clearance to the lower profile 15 of the arm 10 when the flap 12 is fully articulated inwards.

Figure 7:
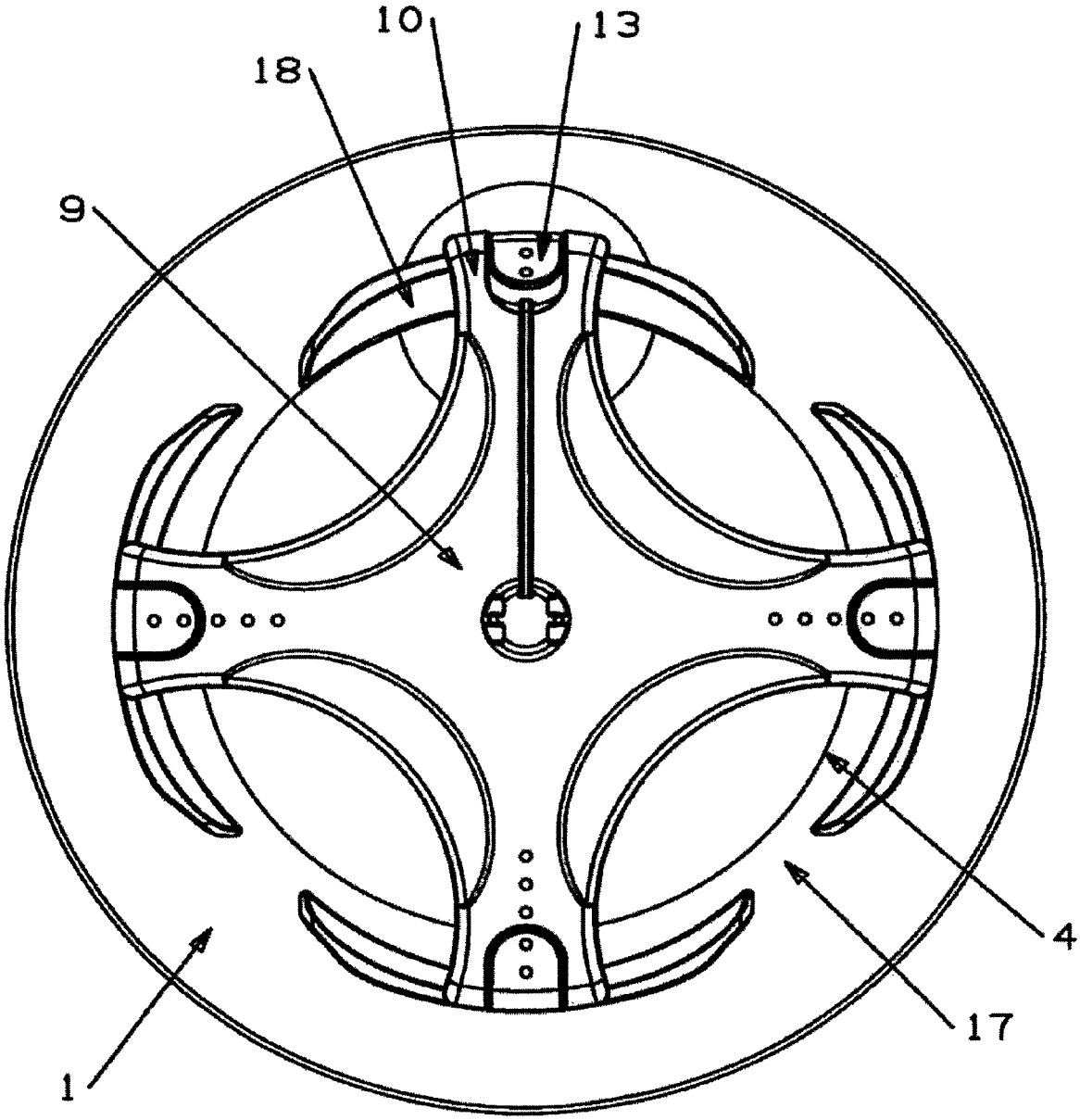
FIG. 7 is a plan view of a preferred embodiment of the invention showing a ball acting on a flap.
Figure 8:
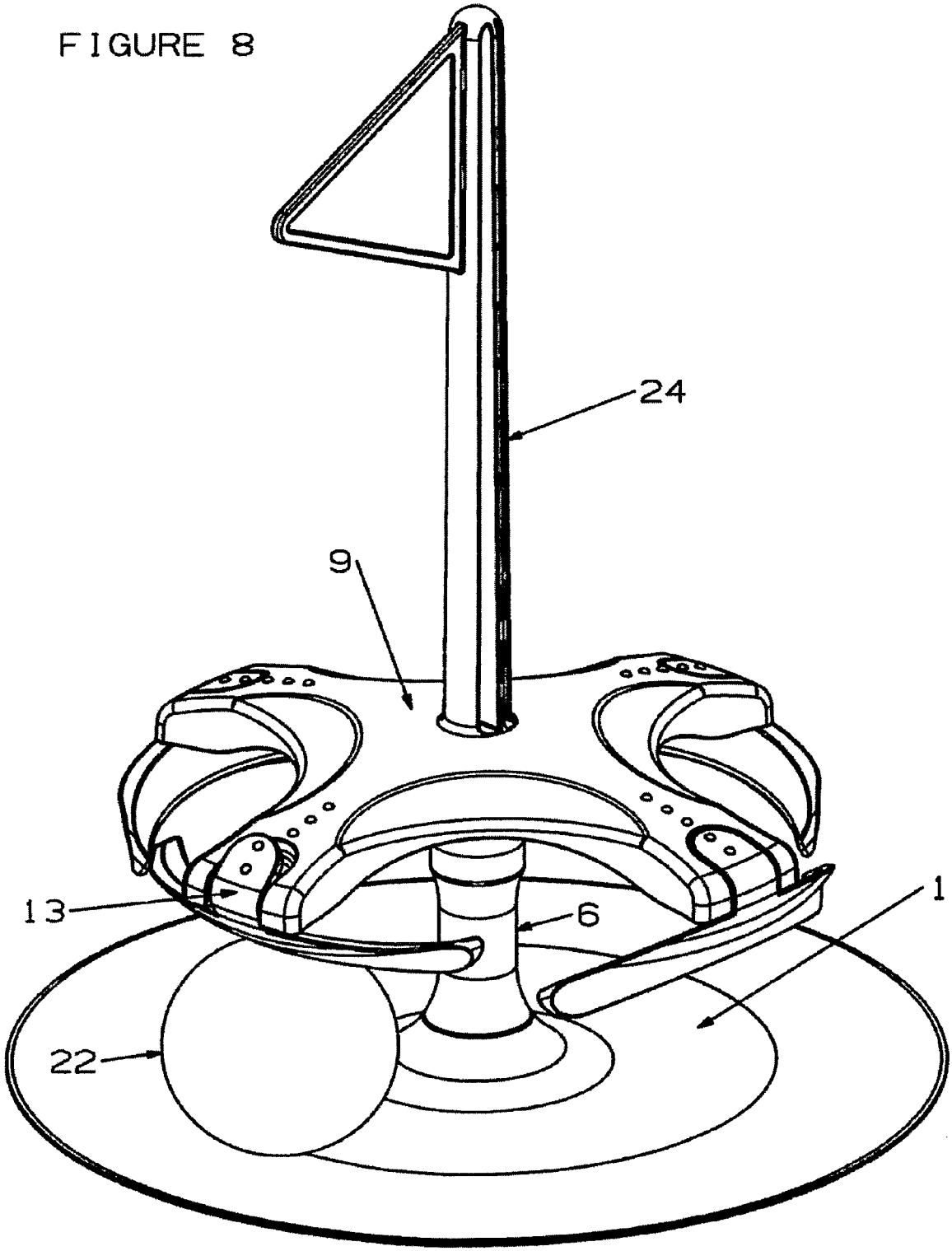
FIG. 8 is a perspective view of the preferred embodiment shown in FIG. 7.
Figure 9:
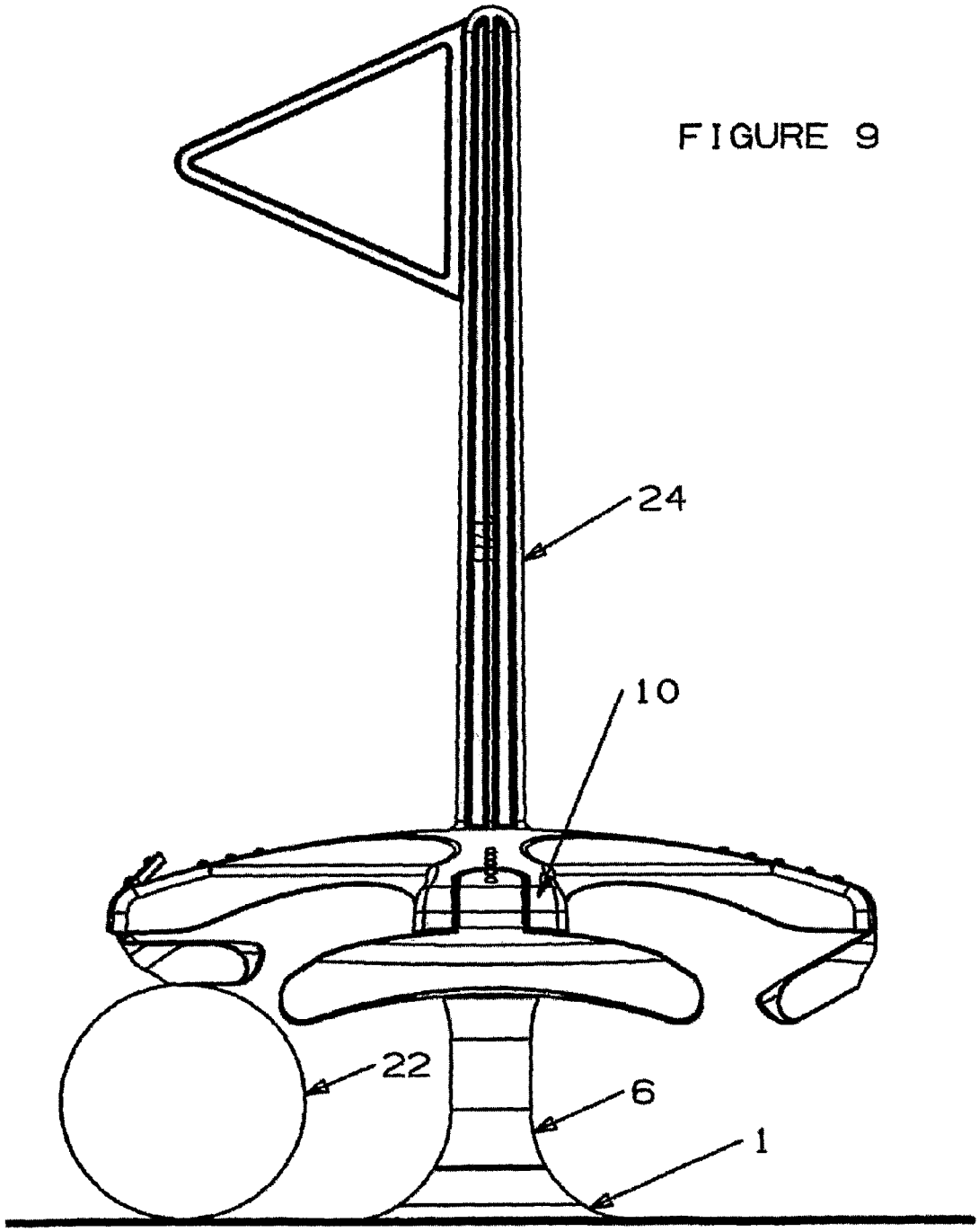
FIG. 9 is a side view of the preferred embodiment shown in FIG. 8.

A preferred embodiment of the invention is illustrated in FIGS. 7 to 9. Comparing, in particular, FIGS. 2 and 7; and FIGS. 6 and 8 the differences evident in this, the preferred embodiment, the base 1 is illustrated without the optional chamfer 2 about its outer edge; and the flaps 12 whilst extending either side of the hinge 11 in a generally curved manner being concentric to the simulated hole 4 the flap sides 16 do not include a tab 20 extending inwards. All other common features are present.

The mode of working is illustrated in FIGS. 1 to 9 and described in the following examples. The device is placed on a suitable surface. A ball 22 rolls on said surface in a straight path approximately towards the centre of the device. The ball 22 rolls on to base 1 which is sufficiently thin to minimise any disturbance to the direction or speed of the ball. Upon contacting flap 12 the ball causes it to rotate inwards until the ball 22 can pass underneath flap 12. Once the ball 22 is inside tie device and no longer in contact with the flap 12 the flap 12 returns to its rest position thereby trapping ball 22.

In another example ball 22 approaches tangentially to the simulated hole 4 or at an angle other than directly towards tie centre of the device. Upon contacting flap 12 ball 22 causes flap 12 to rotate inwards. If a ball 22 contacts flap side 16 then the chamfer or radius 19 and or tab 20 (if present) will slide up the surface of ball 22 causing flap 12 to rotate inwards.

In all embodiments if the centre of ball 22 crosses lower edge 18 of flap 12 then ball 22 will continue or be deflected inwards to be captivated by the device. If ball 22 does not cross lower edge 18 then ball 22 will continue on its present path and flap 12 will return to its rest position without trapping ball 22. In all examples, once inside tie device, ball 22 is prevented from leaving the device as tie flaps 12 are prevented from rotating outwards by tab 13. In situations where the ball 22 is travelling at such a speed that it would not fall into a normal hole this may be simulated by carrier 9 in a number of ways. For example the carrier 9 may tip or lift vertically off the top of post 6 to allow the ball 22 to escape from the device in a similar manner to normal ball behaviour. To aid carrier 9 to tip or lift it may be mounted on a conical or rounded spigot 7. Alternatively, this escape can be facilitated by the carrier 9 being formed from a resiliently deformable preferably plastics material which in such a situation will sufficiently distort or flex upon impact to allow the ball to escape.

A feature of the device so described is the compact and portable size when the flap and A feature of the device so described is the compact and portable size when the flap and carrier assembly is disassembled from the post and the post is disassembled from the base, allowing all the components to be packaged in a small flat box.

An enhancement to the device is flagpole 24 which fits into a hole 25 in top of post 6.

Another enhancement is spike 26 which fits into hole 27 in the bottom of post 6. This spike 26 then protrudes from the bottom of the device to give it additional stability on soft ground.

In a further embodiment carrier 9 is suspended from the bottom of a post or arched rod which is attached to a fixed or portable structure. This allows the removal of post 6 thereby further enhancing the simulation of a hole.

Since the flap 12 is mounted to be freely moveable and is designed to have low inertia, it causes negligible deflection to the ball's direction or speed. At its operating point the profile of the flap's lower edge 18 approximates the hole but acts upon the top rather than the bottom of the ball. Hence the device accurately simulates a real golf hole without the need for an actual hole. The base has also been selected to be particularly thin so that it does not substantially deflect the trajectory of the ball.

In order to accurately simulate a golf ball being sent into a hole, the carrier and/or carrier and post assemblies are inherently flexible structures sufficient so that when the ball enters beneath the carrier and impacts the flaps located at the opposite side from the entry of the ball, the carrier and/or carrier and post assemblies can deflect elastically to allow the exit of the ball if the ball is above a pre-determined velocity corresponding to the velocity by which a golf ball travelling into a hole would instead of sinking into the hole exit the hole even though its trajectory passes over the hole.

The invention claimed is:

1. A ball trap that simulates a hole in a generally horizontal surface along which a ball of known diameter may travel, the ball trap comprising:

a carrier and a support for supporting the carrier above the generally horizontal surface;

a plurality of retaining flaps held by the carrier and circumferentially spaced about the carrier in a generally circular array arranged to capture the ball between at least one flap and the horizontal surface, the flaps being T-shaped with the center piece of the T joined to a hinge and the cross piece of the T having a curved edge with a relatively large radius of curvature in top plan view in a center region and a smaller radius of curvature in each end portion of the cross piece of the T, thereby reducing the likelihood a ball will strike an end of the cross piece of the T and be outwardly deflected; and a plurality of hinges for connecting the retaining flaps to the carrier allowing the retaining flaps to be pushed inwards and upward by contact with the ball, from a position of rest to a raised position and then returning to the rest position after the ball has passed, thereby capturing the ball;

wherein each retaining flap, when viewed in radial side elevation, defines a ball-engaging surface having an arcuately curved lower edge, such that a height between the ball-engaging surface and the horizontal surface is smallest adjacent the ends of the flap when the flap is in its rest position and which is shaped so as to approximate the edge of a simulated circular hole when the flap is in its raised position.

2. A ball trap that simulates a hole in a generally horizontal surface along which a ball of known diameter may travel, the ball trap comprising:

a carrier and a support for supporting the carrier above the generally horizontal surface;

four retaining flaps held by the carrier and circumferentially spaced about the carrier in a generally circular array arranged to capture the ball between at least one flap and the horizontal surface, the flaps being spaced outward from the hole and having a curvature that is concentric with an outline of the hole when viewed in top plan view and having a ball-engaging surface that is substantially downwardly arch shaped relative to the trap on a lower edge in side view and has a substantially similar radius of curvature to a radius of curvature of the hole in top plan view when the flap is in a raised position; and a plurality of hinges for connecting the retaining flaps to the carrier allowing the retaining flaps to be pushed inwards and upward by contact with the ball, from the rest position to the raised position and then returning to the rest position after the ball has passed, thereby capturing the ball.

3. A ball trap according to claim 2, wherein each retaining flap's ball-engaging surface is continuous, and extends circumferentially from the hinge in both directions generally substantially concentric to the simulated hole.

4. A ball trap according to claim 2, wherein each retaining flap is T-shaped and the cross piece of the T incorporates the ball-engaging surface and the center piece of the T is joined to the carrier by the hinge.

5. A ball trap according to claim 2, wherein the carrier is freely rotatable relative to the support.

6. A ball trap according to claim 2 wherein each retaining flap has a projection which meets an abutment on the carrier when the flap is in the rest position, said abutment being configured to prevent the retaining flap from being able to swing outwards to release the ball.

7. A ball trap according to claim 2, wherein at least one of the retaining flap, the carrier, and the support is configured so that when the ball travels at a velocity in excess of a predetermined value, it causes at least one of the flap, the carrier and the support to deflect to allow the ball to escape from the trap, which then returns elastically to its original configuration.

8. A ball trap according to claim 2, further comprising a base plate attached to the support and extending radially outward therefrom for lying upon the generally horizontal surface, so that the ball when trapped rests upon the base plate.

9. A ball trap according to claim 2, wherein each retaining flap is T-shaped with the cross piece of the T having two end portions with relatively smaller radii of curvatures compared to a center portion of the cross piece of the T, thereby reducing the likelihood a ball will strike an end of the cross piece of the T and be outwardly deflected.

* * * * *